US010190362B2

(12) United States Patent
Fischer

(10) Patent No.: US 10,190,362 B2
(45) Date of Patent: Jan. 29, 2019

(54) SECTIONAL DOOR WITH PIVOTABLE GUIDE ROLLERS

(71) Applicant: SEUSTER KG, Lüdenscheid (DE)

(72) Inventor: Jörg Fischer, Dortmund (DE)

(73) Assignee: SEUSTER KG, Luedenscheid (DE)

( * ) Notice: Subject to any disclaimer, the term of this patent is extended or adjusted under 35 U.S.C. 154(b) by 137 days.

(21) Appl. No.: 15/304,210

(22) PCT Filed: Apr. 15, 2015

(86) PCT No.: PCT/EP2015/000794
§ 371 (c)(1),
(2) Date: Oct. 14, 2016

(87) PCT Pub. No.: WO2015/158432
PCT Pub. Date: Oct. 22, 2015

(65) Prior Publication Data

US 2017/0044820 A1 Feb. 16, 2017

(30) Foreign Application Priority Data

Apr. 15, 2014 (DE) ..... 10 2014 005 578

(51) Int. Cl.
*E06B 9/06* (2006.01)
*E06B 9/15* (2006.01)
(Continued)

(52) U.S. Cl.
CPC ..... *E06B 9/15* (2013.01); *E06B 9/0638* (2013.01); *E06B 9/17076* (2013.01); *E06B 9/58* (2013.01);
(Continued)

(58) Field of Classification Search
CPC ..... E06B 9/15; E06B 9/0638; E06B 9/17076; E06B 9/58; E06B 2009/1522;
(Continued)

(56) References Cited

U.S. PATENT DOCUMENTS 4,115,900 A 9/1978 Mihalcheon
4,793,397 A * 12/1988 Whiteman ..... E05D 15/165 160/201
(Continued)

FOREIGN PATENT DOCUMENTS

DE 20 2006 017 619 U1 5/2007
DE 102010000556 A1 * 8/2011 ..... E06B 9/15
(Continued)

OTHER PUBLICATIONS

PCT Search Report dated Aug. 10, 2015 for priority PCT application, PCT/EP2015/000794. (The original Search Report is in German. We are supplying the original Search Report in German [3 pgs] and also an English translation [2 pgs].).

*Primary Examiner* — Robert Canfield
(74) *Attorney, Agent, or Firm* — Stinson Leonard Street LLP

(57) ABSTRACT

Door with a door leaf which, starting from a closed position, can be wound up to form a multi-layer winding in the course of an opening movement and has a plurality of slats which customarily extend horizontally with their longitudinal axes approximately perpendicular to the direction of the opening movement, and with a guide arrangement for guiding the opening movement comprising preferably helically shaped guide rails in the region of the lateral edges of the slats in planes extending approximately perpendicularly to the longitudinal axes of said slats, and guide elements mounted on lateral edges of the slat which leads during the opening movement can be introduced into the radially outermost windings of said guide rails, wherein the guide elements (42) are fastened to the lateral edges of the leading slat (40) via pivot levers (50) on the leading slat and are mounted on the slat so as to be pivotable with respect to pivot axes extending parallel to the longitudinal axis of the slat.

13 Claims, 7 Drawing Sheets

Figure 1A:
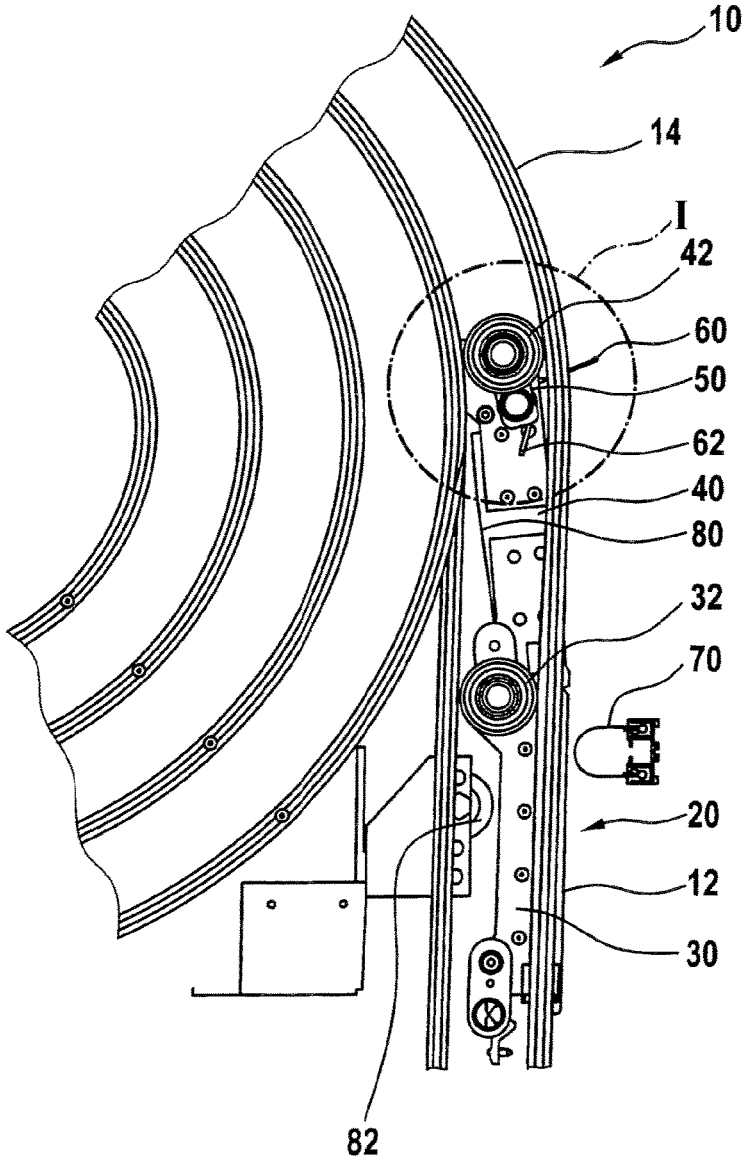

(51) Int. Cl.
*E06B 9/17* (2006.01)
*E06B 9/58* (2006.01)

(52) U.S. Cl.
CPC ..... *E06B 2009/0684* (2013.01); *E06B 2009/1522* (2013.01); *E06B 2009/1566* (2013.01); *E06B 2009/588* (2013.01)

(58) Field of Classification Search
CPC ..... E06B 2009/1566; E06B 2009/0684; E06B 2009/588
USPC ..... 160/120, 133, 238
See application file for complete search history.

(56) References Cited

U.S. PATENT DOCUMENTS

| | | | | |
|---|---|---|---|---|
| 5,484,007 | A * | 1/1996 | Rejc | E06B 3/485 160/133 |
| 5,488,982 | A * | 2/1996 | Rejc | E06B 3/485 160/133 |
| 5,909,762 | A | 6/1999 | Denoual et al. | |
| 6,098,696 | A * | 8/2000 | Styra | B21C 23/145 160/201 |
| 2014/0246157 | A1 * | 9/2014 | Letonje | E06B 9/0646 160/188 |

FOREIGN PATENT DOCUMENTS

| | | | |
|---|---|---|---|
| DE | 202012012514 | U1 | 4/2013 |
| DE | 102012101425 | A1 | 8/2013 |
| DE | 20 2013 005 164 | U1 | 9/2013 |
| GB | 1313208 | A | 4/1973 |

* cited by examiner

OLD

Fig. 4b
NEW
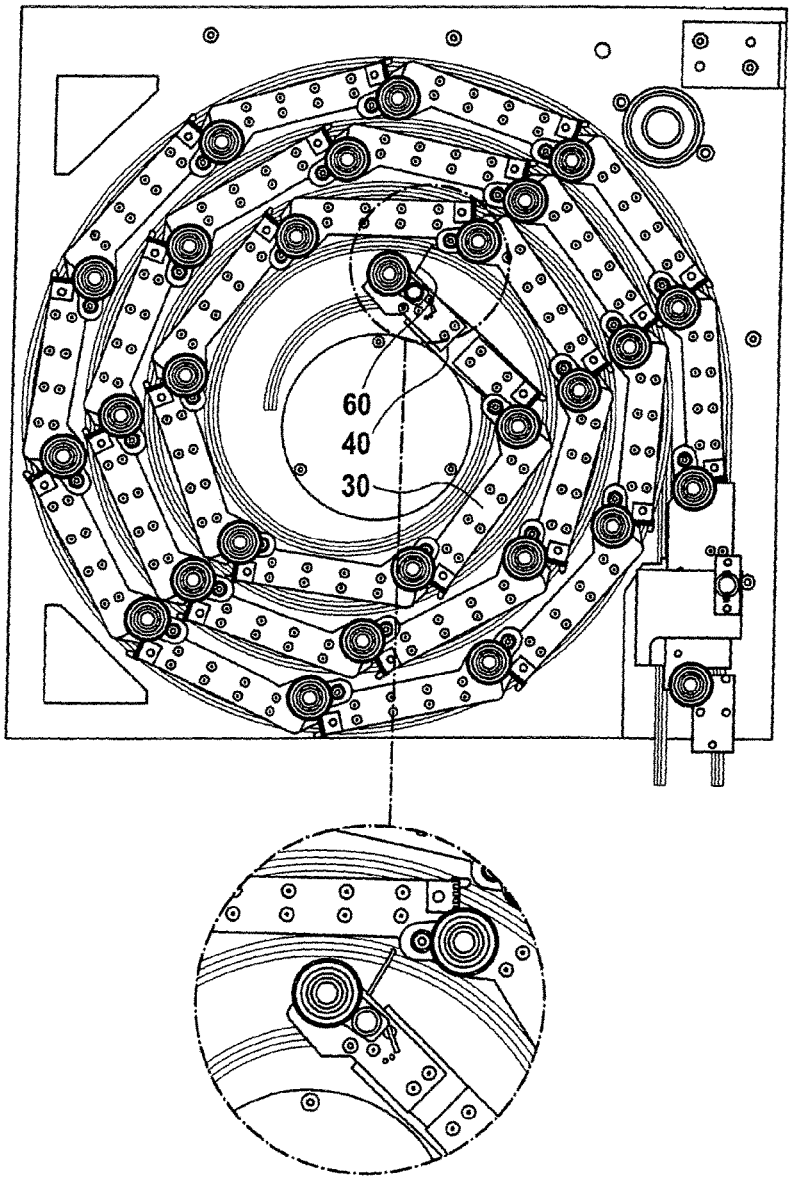

SECTIONAL DOOR WITH PIVOTABLE GUIDE ROLLERS

The invention relates to a door having a door leaf which, starting from a closed position, can be wound to form a multi-layer roll in the course of an opening movement and has a plurality of slats which normally extend horizontally with their longitudinal axes approximately perpendicular to the direction of the opening movement, and having a guide arrangement for guiding the opening movement, with guide rails that preferably revolve spirally in the region of the lateral edges of the slats in the open position, in planes extending approximately perpendicular to the longitudinal axes of the slats and with guide elements, which are mounted to lateral edges of the leading slat in the opening movement and can be introduced into the radially outermost windings of the guide rails.

Doors of this kind in the form of roll-up doors or spiral doors are used to close room openings and passages. In simple roll-up doors, the door leaf can be embodied in the form of a panel-shaped hanging, which is wound onto a winding shaft in the course of the opening movement. With regard to the thermal insulation properties that are desired in some cases, for example when using such doors for cold-storage or deep-freeze rooms, but also for heating chambers, for example for vulcanizing automotive tires, it is necessary for the door leaf to have thermal insulating properties. To that end, a panel-shaped hanging can be equipped with suitable insulation elements. Such doors are described, for example, in DE 20 2013 005 164.

If in addition to a thermal separation, a secure closure of the opening is also desired, for example in order to ensure sufficient protection from burglary, doors are used in which the door leaf is composed of rigid slats, which are connected to one another by articulation relative to the articulating axes extending perpendicular to the movement path. The articulated connection can be embodied in the form of so-called insertion profiles. In addition or alternatively, hinge-like connections can also be provided between the slats. Doors of this kind are described in DE 20 2006 017 619. With regard to reducing the noise load produced during an opening or closing movement of corresponding doors, it is generally desirable to maintain a space between successive windings of the multi-layered roll in the open position, which enables contactless unwinding of the multi-layered roll and contactless winding into a multi-layered roll. A corresponding space in the region of the open position can be ensured if the slats are equipped with guide elements at their lateral edges, which in the course of the opening movement, travel into guide rails that can be arranged in planes extending approximately perpendicular to the longitudinal axes of the slats and expediently revolve spirally. By adapting the dimensions of the guide elements to the guide rails, it is possible to ensure virtually play-free guidance, and in doing so, the dimensioning and/or the curve of the guide rails can ensure that contactless winding and unwinding of the door leaf takes place.

Corresponding doors can have desirable thermal properties and/or insulating properties if the slats are at least partially composed of a thermally insulating material such as plastic, particularly in the form of a foam and especially preferred in the form of a polyurethane foam. The thermally insulating material can be contained in stabilizing webs of material such as shells made of a metallic material.

With regard to the thermal insulation, in addition to the thermal properties of the slats, the seal relative to the structure also plays an important role. In this case, it has turned out to be particularly problematic to close the gap that occurs in the lintel region, i.e. at the upper edge of the door leaf in the closed position. A seal that functions in a contacting fashion and is embodied as a brush or loop of flexible material causes abrasion marks on the slats when the slats slide along the seal in the course of the closing or opening movement. A seal that functions in a contactless fashion against the structure prevents damages to the slat, but in the closed position of the door leaf, a gap remains that promotes heat transfer. The proposal has also already been made to produce the seal in the lintel region by means of sealing arrangements that are mounted to the leading slat in an opening movement, i.e. to the uppermost slat in the closed position. In this case, however, it has turned out to be problematic that as the door is being rolled up into the multi-layered roll, corresponding sealing arrangements strike against slats of an adjacent roll layer and cause unwanted noise emission and possibly also abrasion marks.

In view of these problems in the prior art, the object of the invention is to provide a door with which it is possible to ensure a sealed closure in the lintel region without the occurrence of damage to the slats and/or any unwanted noise emission.

According to the invention, this object is attained by an enhancement of the known doors, which is essentially characterized in that the guide elements are fastened to the lateral edges of the leading slat in the opening movement by means of pivoting levers on the leading slat, which are pivotably mounted to the slat relative to pivot axes extending approximately parallel to the longitudinal axis of the slat.

Since the guide element is accommodated in the guide rails with a small amount of play, the leading slat can be pivoted relative to the guide element in such a way that a sealing arrangement possibly mounted to it, with a simultaneously reliable guidance of the opening movement, is shifted in such a way that it no longer comes into contact with the slats of an adjacent winding layer. On the other hand, the slat can be pivoted relative to the guide element when the closed position is reached in such a way that a reliable seal is produced. On the whole, it is thus possible to achieve a tight seal of the opening in the lintel region while avoiding damage to individual slats and an unwanted noise emission.

For purposes of a low-noise door leaf movement, it has proven to be expedient if at least one guide element has a guide roller that is pivotably mounted to the pivoting lever relative to a roller axis extending parallel to the pivot axis.

If the sealing arrangement on the leading slat in the opening movement protrudes into the exterior space in the closed position of the door leaf, a contactless opening movement can be achieved if in the course of the opening movement, by pivoting of the pivoting lever about the pivot axis relative to the spiral axis or winding axis, the guide element is shifted radially outward relative to the leading slat so that a leading edge of the leading slat is shifted radially inward relative to the spiral axis. The outward-protruding sealing arrangement is then shifted with the leading slat so that the sealing arrangement on the leading slat, which, in the open state, constitutes the beginning of the innermost winding layer, can have a radial distance from the next winding layer.

A reliable sealing closure can be achieved in doors according to the invention if, when the closed position is reached, a sealing arrangement arranged on the leading slat and, in the open position, in its position of rest arranged between successive winding layers, can be shifted from the position of rest into a sealing position, in which it preferably rests against a stationary sealing device by pivoting of the leading slat about the pivot axis relative to guide elements on the leading slat that are guided in the guide rail.

In order to ensure a contactless movement, it has proven to be expedient if a prestressing device is provided, which pushes the leading slat into a predetermined direction relative to the pivoting lever, particularly into the position of rest of the sealing arrangement. Subject to the action of the prestressing device, the positioning of the sealing arrangement is ensured in the position of rest during the opening movement. For shifting the sealing arrangement into the sealing position, a positioning device can be provided, by means of which, when the closed position is reached, the leading slat can be shifted from the position of rest into the sealing position against the prestressing force of the prestressing device.

A corresponding positioning device can be implemented in a particularly simple way if it has a first positioning element mounted to the leading slat, for example a ramp-shaped contact surface or positioning roller, and a stationary second positioning element that comes into contact with the first positioning element when the closed position is reached, for example a positioning roller or a ramp-shaped contact surface. By moving the positioning element, which is fastened to the leading slat, relative to the second positioning element, it is possible to accomplish the desired shifting of the leading slat and, as a result, also of the sealing arrangement into the sealing position. In order to ensure the desired operational reliability of a door according to the invention, it can be useful if a stop arrangement that is stationary relative to the leading slat is provided in order to limit the pivoting movement of the pivoting lever.

As in conventional doors, in doors according to the invention, it is usual to provide for at least two successive slats in the direction of movement to be connected to each other by articulation relative to articulating axes that extend parallel to their longitudinal axes. In this arrangement, guide elements, in particular guide rollers, can be mounted to the lateral edges of two, three, or a plurality of, in particular all of the successive slats, and cooperate with the guide arrangement to enable door leaf movement.

By the pivoting movement of the leading slat relative to the pivoting lever, the leading slat can reach the region of the guide rail. To ensure trouble-free operation, it may therefore be useful to embody the leading slat shorter in its longitudinal direction than the subsequent slats so that between the two lateral edges of the leading slat and the corresponding lateral edges of the subsequent slat, an axial gap is formed. The leading slat is then arranged symmetrically relative to the subsequent slat and can if need be penetrate between the guide rails arranged in planes extending perpendicular to the longitudinal axes.

Finally, it is also expedient in doors according to the invention if a drive unit, such as a geared motor, which is preferably coupled to a shaft trailing in an opening movement, is provided for moving the door leaf.

Figure 1B:
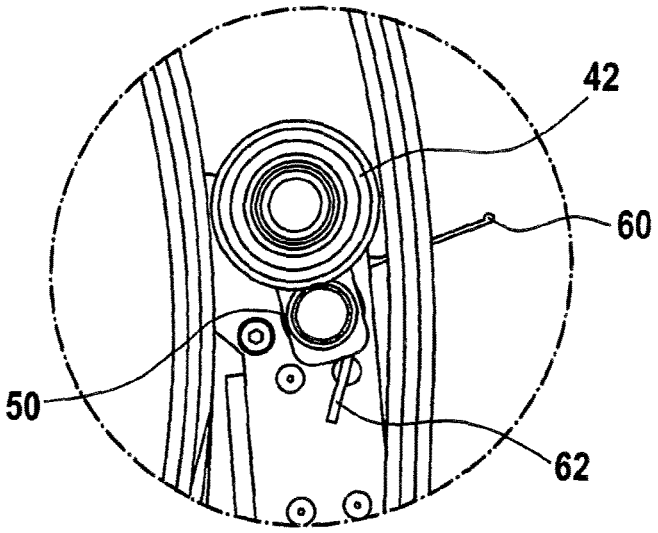

The invention will be explained below with reference to the drawing, which is expressly referred to with regard to all details that are essential to the invention and are not emphasized in detail in the description. In the drawings:

FIG. 1*a* is a schematic representation of a door according to the invention, in which the door leaf has almost reached the closed position, FIG. 1*b* shows an enlarged partial sectional view indicated at I in FIG. 1*a*.

Figure 1C:
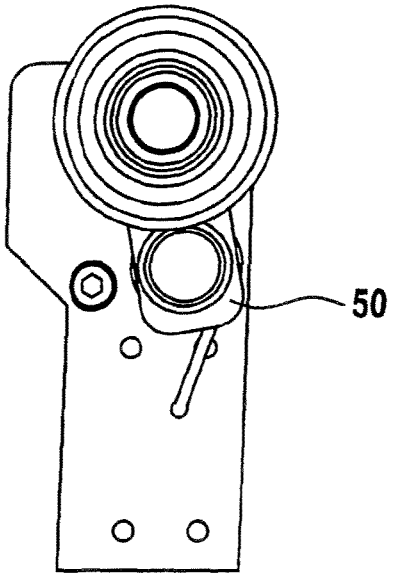
Figure 2A:
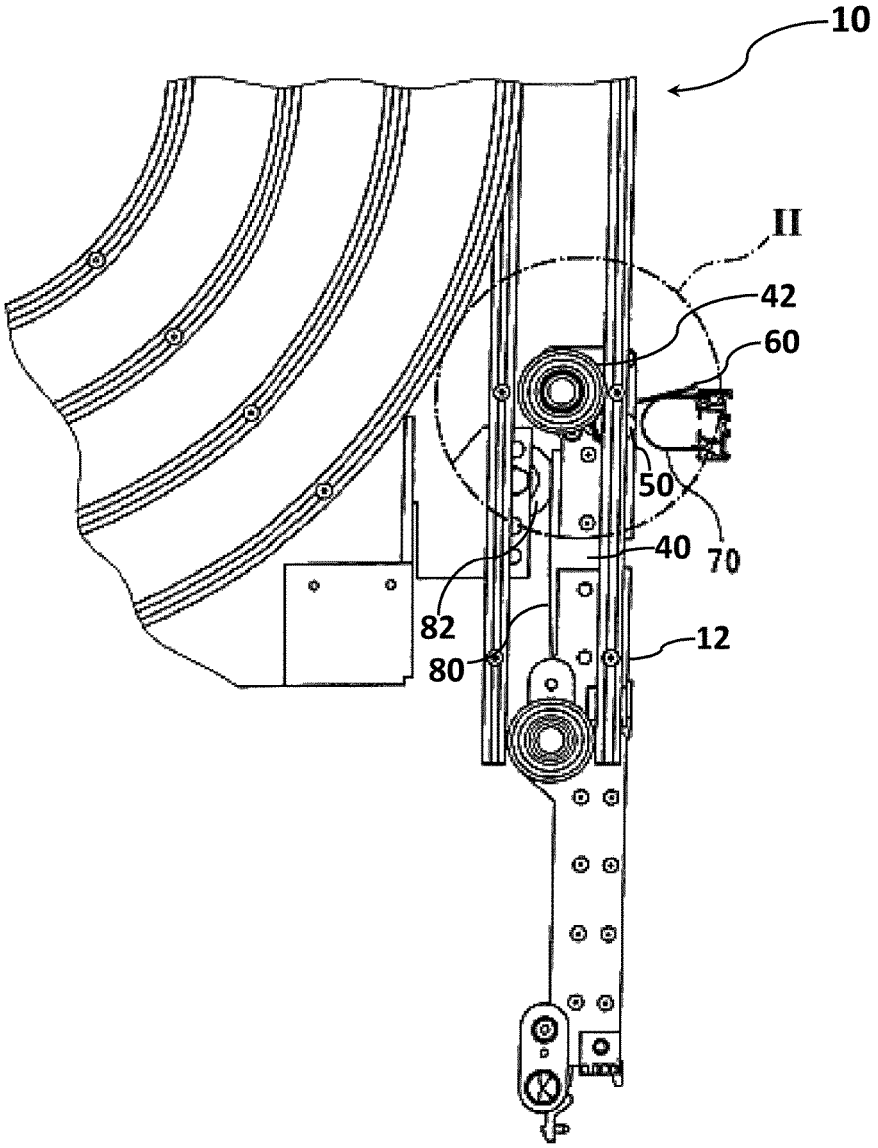
Figure 2B:
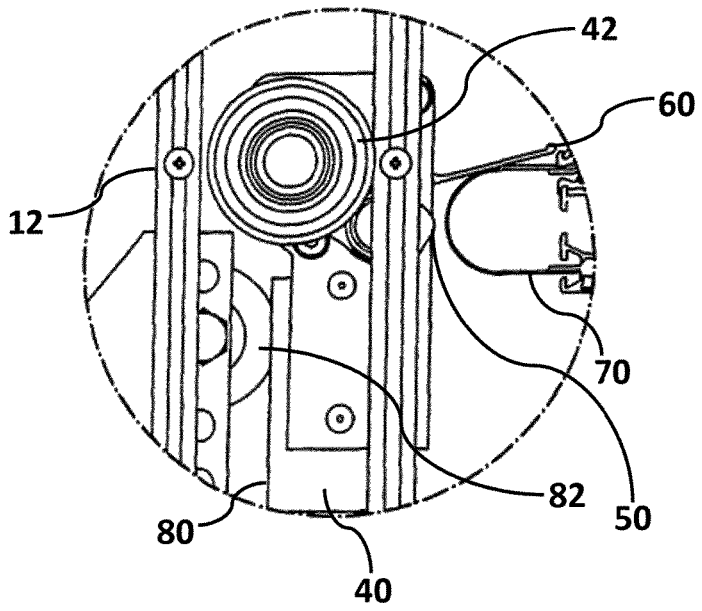

FIG. 1*c* is a partial sectional view in the intermediate position according to the embodiment shown in FIG. 1*a*, FIG. 2*a* is a schematic representation of a door according to the invention, with the door leaf in the closed position, FIG. 2*b* shows an enlarged partial sectional view indicated at II in FIG. 2*a*.

Figure 2C:
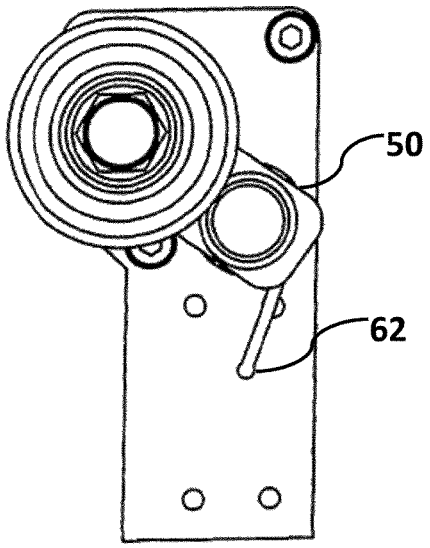
Figure 3:
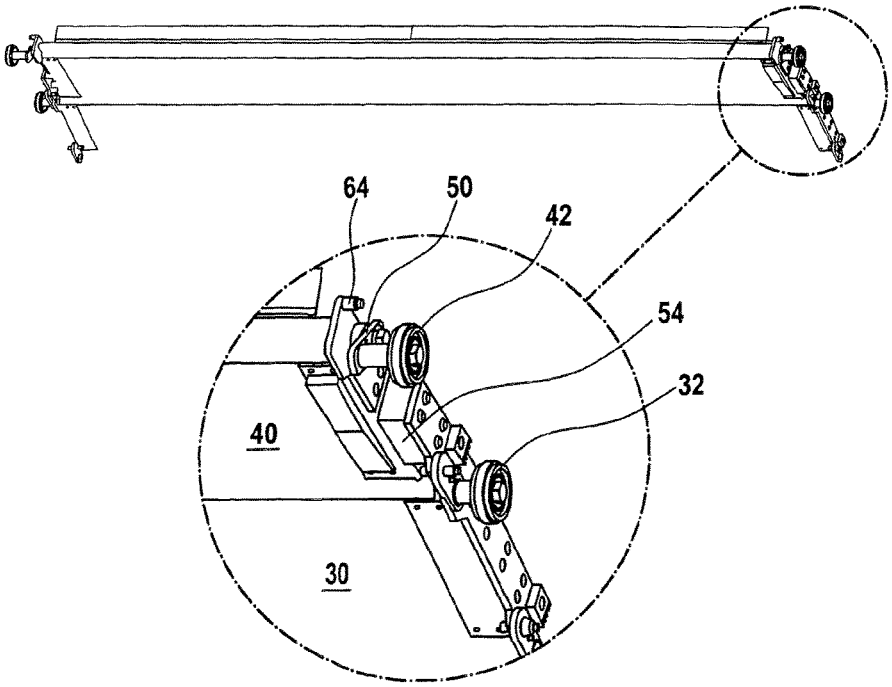
Figure 4A:
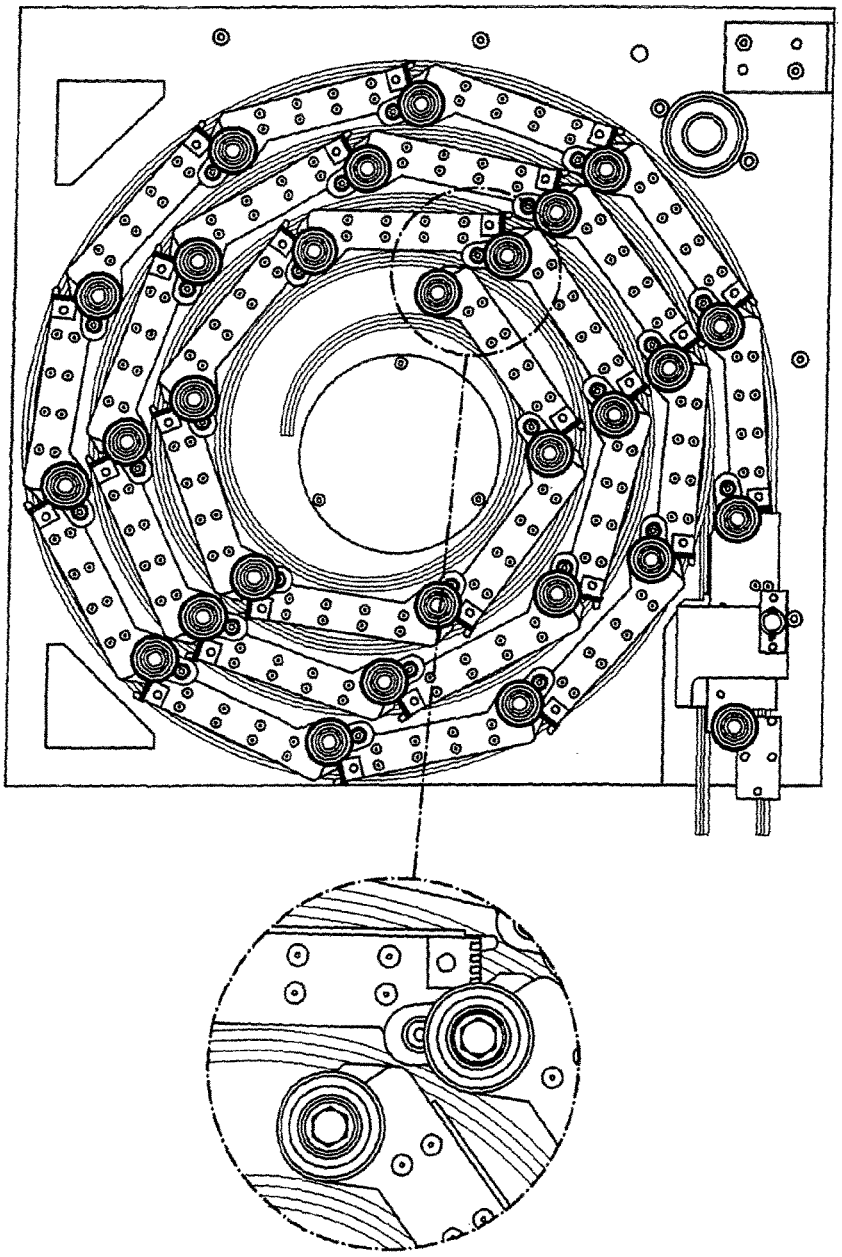

FIG. 2*c* is a partial sectional view in the sealing position according to the embodiment shown in FIG. 2*a*, FIG. 3 is a partial perspective view representation of the door according to the invention, and FIGS. 4*a*-4*b* is a comparison of doors according to the prior art (FIG. 4*a*) and doors according to the invention (FIG. 4*b*).

The door shown in the drawings is essentially composed of a guide arrangement labeled as a whole with the reference numeral 10 and a door leaf labeled as a whole with the reference numeral 20. The guide arrangement 10 comprises an essentially linearly extending section 12, which extends in the direction of gravity, approximately parallel to the lateral edges of the door leaf in the closed position of the door leaf, and a section revolving spirally, which adjoins the upper end of the linearly extending section 12, with the linearly extending section 12 transitioning tangentially into the end of the spiral section 14. The spiral section 14 extends in a plane extending perpendicular to the longitudinal axis of the slats 30, 40 of the door leaf. The door leaf 20 comprises a number of door leaf slats 30, 40 arranged one after the other in a direction extending perpendicular to their longitudinal axes, which are each provided with guide rollers 32 and 42 by means of which a door leaf movement is guided between an open position, in which the door leaf is accommodated between the linearly extending sections 12 of the guide rails arranged on both sides of the door leaf, and a closed position, in which the door leaf is wound into a multi-layered roll in the spiral section 14 of the guide rail. By means of a hinge-like connection, the slats 30, 40 are connected to one another pivotable relative to pivot axes extending parallel to the longitudinal axes of the slats.

The guide roller 42, which is mounted to the leading door leaf slat 40 in an opening movement, is fastened to the leading slat 40 pivotable relative to a pivot axis extending parallel to the longitudinal axis of the slat 40 via a pivoting lever 50. In addition, the leading edge of the leading slat 40 in an opening movement has an outward-protruding sealing strip 60 mounted to it.

As is particularly visible in FIGS. 2*a*-2*c*, when the closed position is reached, the sealing strip 60 comes into contact with a hollow chamber seal 70 that is mounted in the region of the lintel of the opening that is to be closed. The hollow chamber seal 70 is embodied as a short loop composed of an elastomer material. For this purpose, when the closed position is reached, by means of a positioning device, the slat 40 is pushed from the intermediate position shown in FIG. 1*a* into the sealing position shown in FIG. 2*a* against the prestressing force of a prestressing spring 62. The positioning device has a contact surface 80 mounted to the inner delimiting surface of the slat 40, which is embodied wedge-shaped and starting from the inside of the slat, slopes upward in the direction of the leading edge of the slat 40 in an opening movement, and has a positioning roller 82, which is mounted to the vertically extending section 12 of the guide rail arrangement 10.

When the closed position shown in FIGS. 2*a*-2*c* is reached, the contact surface 80 runs onto the positioning roller 82 and pushes the leading slat 40 in an opening movement outward relative to the guide roller 42; at the same time, the sealing strip 60 comes into contact with the hollow chamber seal 70. The pivoting movement of the slat 40 is made possible by the articulated coupling of the guide roller 42 via the pivoting lever 50, a low-play movement of the leading slat in the opening movement being achieved by the accommodation of the guide roller 42 in the guide rail 10.

When leaving the closed position shown in FIGS. 2*a*-2*c*, by means of the prestressing spring 62 together with the sealing strip 60 the leading slat 40 in an opening movement is pushed inward relative to the guide roller 42 toward the spiral axis of the spiral section 14 of the guide rail. Starting from the sealing position shown in FIG. 2 *c*), via the intermediate position shown in FIG. 1 *c*), it reaches the position of rest shown in FIG. 4 *b*), which it reaches between successive windings of the door leaf that is wound into a multi-layer roll, without touching slats of the adjacent windings of the door leaf, as is seen in known doors that are shown in FIG. 4 *a*).

Despite the low-play guidance of the guide rollers 32 and 42 in the spiral guide rail section 14, the pivoting of the leading slat 40 relative to the pivoting lever 50 permits pivoting of the leading slat 40 relative to the subsequent slat 30 by an angle that is greater than the angle by which the slat 30 can be pivoted relative to the slat that follows it.

On the whole, with a door according to the invention, an opening and closing movement into the spiral section 14 or out of the spiral section 14 is made possible, without the sealing strip 60 of the slats striking against or coming into a dragging contact with an adjacent winding layer.

As is particularly evident in FIG. 3, the leading slat 40 in an opening movement has a shorter axial length than the subsequent slat 30. It can be pivoted by a pivoting movement about the pivot axis between the guide rail section arranged at the lateral edges of the slat. In order to bridge the distance between the axial ends of the slats 30 and 40, a spacer 54 is provided, which permits a hinged connection to be mounted between these successive slats. The shortening of the leading slat in an opening movement moreover provides clearance for the pivoting lever 50 to permit the pivoting coupling of the guide roller 42 to the leading slat 40 in an opening movement. The pivoting movement of the pivoting lever 50 is limited by a stop 64, which is mounted to the slat 40. This prevents the slat 40 from being pivoted too far inward as it enters into the spiral section 14 of the guide rail 10. Using a similar stop arrangement, it is possible to prevent the slat from being pivoted too far outward when the closed position is reached. Since the movement of the slat into the sealing position is not assisted by a prestressing device, however, it is not necessary to provide a second stop arrangement. The second stop arrangement may be expedient, in order to mechanically limit the pivoting range in the event of a spring fracture and to prevent collisions. In addition, this creates the possibility of immobilizing the profile in the pivoted position in the event of a spring fracture in order to maintain the door function on an interim basis.

In all embodiments of the invention, a drive unit can be provided that preferably acts on the slat, which trails in an opening movement, and assists a movement of the door leaf between the open position and the closed position.

The invention is not limited to the embodiment described in conjunction with the drawing. For example, instead of a spiral guide rail, it is also conceivable to provide an oval guide rail that has a number of guide rail windings. Naturally, it is also possible to mount the positioning roller to the slat 40, while the contact surface is provided on the guide rail. Embodiments in which only a few slats are equipped with guide rollers are also conceivable.

Despite the low-play guidance of the guide rollers 32 and 42 in the spiral guide rail section 14, the pivoting of the leading slat 40 relative to the pivoting lever 50 permits pivoting of the leading slat 40 relative to the subsequent slat 30 by an angle that is greater than the angle by which the slat 30 can be pivoted relative to the slat that follows it.

On the whole, with a door according to the invention, an opening and closing movement into the spiral section 14 or out of the spiral section 14 is made possible, without the sealing strip 60 of the slats striking against or coming into a dragging contact with an adjacent winding layer.

As is particularly evident in FIG. 3, the leading slat 40 in an opening movement has a shorter axial length than the subsequent slat 30. It can be pivoted by a pivoting movement about the pivot axis between the guide rail section arranged at the lateral edges of the slat. In order to bridge the distance between the axial ends of the slats 30 and 40, a spacer 54 is provided, which permits a hinged connection to be mounted between these successive slats. The shortening of the leading slat in an opening movement moreover provides clearance for the pivoting lever 50 to permit the pivoting coupling of the guide roller 42 to the leading slat 40 in an opening movement. The pivoting movement of the pivoting lever 50 is limited by a stop 64, which is mounted to the slat 40. This prevents the slat 40 from being pivoted too far inward as it enters into the spiral section 14 of the guide rail 10. Using a similar stop arrangement, it is possible to prevent the slat from being pivoted too far outward when the closed position is reached. Since the movement of the slat into the sealing position is not assisted by a prestressing device, however, it is not necessary to provide a second stop arrangement. The second stop arrangement may be expedient, in order to mechanically limit the pivoting range in the event of a spring fracture and to prevent collisions. In addition, this creates the possibility of immobilizing the profile in the pivoted position in the event of a spring fracture in order to maintain the door function on an interim basis.

In all embodiments of the invention, a drive unit can be provided that preferably acts on the slat, which trails in an opening movement, and assists a movement of the door leaf between the open position and the closed position.

The invention is not limited to the embodiment described in conjunction with the drawing. For example, instead of a spiral guide rail, it is also conceivable to provide an oval guide rail that has a number of guide rail windings. Naturally, it is also possible to mount the positioning roller to the slat 40, while the contact surface is provided on the guide rail. Embodiments in which only a few slats are equipped with guide rollers are also conceivable.

REFERENCE NUMERAL LIST

10 guide arrangement
12 linearly extending section
14 spiral section
20 door leaf
30 slat
32 guide roller
40 leading slat
42 guide roller of the leading slat
50 pivoting lever
54 spacer
60 sealing strip
62 prestressing spring
64 stop
70 hollow chamber seal

80 contact surface
82 positioning element

The invention claimed is:

1. A door having a. a door leaf comprising a plurality of slats which extend horizontally with their longitudinal axes approximately perpendicular to a direction of an opening movement;

b. a guide arrangement for guiding the opening movement of the door leaf, said guide arrangement comprising i. guide rails arranged spirally, relative to a spiral axis parallel to the longitudinal axes of the slats, in layers in planes extending perpendicular to the longitudinal axes of the slats, and ii. guide elements (42) on lateral edges of a leading slat (40) in the direction of opening movement, said guide elements being introducible into radially outermost layers of said guide rails iii. wherein the guide elements (42) at the lateral edges of the leading slat (40) are fastened to the leading slat (40) via pivoting levers (50) and mounted to said leading slat pivotably relative to a pivot axis extending parallel to the longitudinal axis of the slat (40), and wherein the leading slat is pivotable between a position of rest between said spiral layers and a sealing position when the door leaf is in a closed position;

c. a sealing strip (60) being arranged on the leading slat (40) and, movable between an open position when the leading slat is in the position of rest, and a sealing strip sealing position resting against a stationary sealing device located adjacent at least one of said lateral edges when the leading slat is in the sealing position, wherein said sealing strip is movable by pivoting of the leading slat (40) about the pivot axis.

2. The door according to claim 1, wherein at least one guide element comprises a guide roller that is rotatably mounted to at least one of the pivoting levers (50) wherein said rotatable mount is relative to a roller axis extending parallel to the pivot axis.

3. The door according to claim 1 or 2, wherein pivoting of the pivoting lever (50) about the pivot axis shifts, the guide element (42) is shifted with regard to the spiral axis, radially outward relative to the leading slat (40).

4. The door according to claim 1, wherein a prestressing device (62) is configured to push the leading slat (40) relative to the pivoting lever (50) such that the sealing strip is moved into the open position.

5. The door according to claim 4, further comprising a positioning device configured to shift the leading slat (40) from the position of rest into the sealing position against a prestressing force of the prestressing device when the door leaf reaches a closed position.

6. The door according to claim 5, wherein the positioning device (80, 82) has a first positioning element (82), arranged on the leading slat (40) and has a second positioning element (82), which comes into contact with the first positioning element (80) when the closed position is reached.

7. The door according to claim 1, further comprising a stop arrangement (64) that is stationary relative to the leading slat and positioned to limit the pivoting movement of the pivoting lever (50).

8. The door according to claim 1, wherein at least two slats (30, 40) following each other in the direction of movement are connected to each other by articulation relative to articulating axes extending parallel to the longitudinal axes of the slats.

9. The door according to claim 1, wherein the guide elements are mounted to the lateral edges of at least two of successive of said slats (30, 40) in order to guide the opening movement of the door leaf.

10. The door according to claim 1 wherein the leading slat is shorter along the longitudinal direction than subsequent slats and an axial gap is formed between the leading slat and the subsequent slats.

11. The door according to claim 1, further comprising a drive unit for moving the door leaf.

12. The door according to claim 6, wherein the first positioning element is a ramp-shaped contact surface (82) or a positioning roller (82).

13. The door according to claim 6, wherein the second positioning element is a positioning roller (82) or a ramp-shaped contact surface.

* * * * *